US008869466B2

(12) United States Patent
Garcia et al.

(10) Patent No.: US 8,869,466 B2
(45) Date of Patent: Oct. 28, 2014

(54) WATERPROOF DECK FLASHING SYSTEM AND METHOD

(75) Inventors: Joseph Garcia, Benicia, CA (US); Michael Huston, Elk Grove, CA (US)

(73) Assignee: Richard Avelar & Associates, Oakland, CA (US)

( * ) Notice: Subject to any disclaimer, the term of this patent is extended or adjusted under 35 U.S.C. 154(b) by 0 days.

(21) Appl. No.: 13/079,497

(22) Filed: Apr. 4, 2011

(65) Prior Publication Data

US 2013/0055651 A1 Mar. 7, 2013

Related U.S. Application Data

(60) Provisional application No. 61/320,921, filed on Apr. 5, 2010.

(51) Int. Cl.

| | |
|---|---|
| ***E04D 3/24*** | (2006.01) |
| ***E04F 19/00*** | (2006.01) |
| ***E04D 13/15*** | (2006.01) |
| *E04D 13/04* | (2006.01) |

(52) U.S. Cl.

CPC ..... *E04D 13/15* (2013.01); *E04D 2013/0468* (2013.01); *E04F 19/00* (2013.01)

USPC ..... 52/96; 52/60; 52/97; 52/741.3

(58) Field of Classification Search

CPC . E04D 13/1407; E04D 13/1415; E04D 13/15; E04D 13/155; E04D 13/158; E06B 7/14

USPC ..... 52/58, 59, 60, 61, 62, 96, 97, 302.1, 52/302.3, 302.6, 408, 94, 741.3, 741.41, 52/745.05

See application file for complete search history.

(56) References Cited

U.S. PATENT DOCUMENTS

| | | | | |
|---|---|---|---|---|
| 1,886,462 | A * | 11/1932 | Bever | 52/60 |
| 2,271,710 | A * | 2/1942 | Orth | 52/61 |
| 3,533,201 | A | 10/1970 | Tyler | |
| 3,624,973 | A * | 12/1971 | Attaway | 52/60 |
| 3,668,811 | A * | 6/1972 | Pollard | 52/94 |
| 3,735,540 | A * | 5/1973 | Thaler | 52/94 |
| 3,738,068 | A * | 6/1973 | Attaway | 52/60 |
| 4,483,112 | A * | 11/1984 | Rueblinger | 52/94 |
| 4,648,218 | A * | 3/1987 | Butzen | 52/96 |
| 4,800,689 | A * | 1/1989 | Lane | 52/60 |
| 5,189,853 | A * | 3/1993 | Braine et al. | 52/96 |
| 5,414,965 | A | 5/1995 | Kelley | |
| 5,927,023 | A * | 7/1999 | Kittilstad | 52/60 |
| 6,578,322 | B2 * | 6/2003 | Kintop | 52/96 |
| 6,725,617 | B2 * | 4/2004 | Cox | 52/408 |

(Continued)

*Primary Examiner* — William Gilbert

(74) *Attorney, Agent, or Firm* — John C Merchant

(57) ABSTRACT

A two-component deck flashing system and method for installing the same. The system utilizes "L" flashing strips with attached cleats utilizing clinch lock joints to alleviate the need for fasteners which might otherwise penetrate and easily damage waterproof sheeting materials. A cover plate is attached to the cleats to define the outside edge of the topping surface. This two component system is designed for installation at wall-to-deck junctures by incorporating a form of a wall "saddle" flashing having one or more wall plates with attached "L" flashing extension with cleats and cover plate extensions. All components are integrated with and overlapping adjacently installed components to provide a flush, easily sealed and maintained, top surface. This two-component deck flashing system can be installed more easily and effectively in the field than prior art systems.

16 Claims, 9 Drawing Sheets

(56) References Cited

U.S. PATENT DOCUMENTS

| | | | | |
|---|---|---|---|---|
| 6,845,590 | B1 * | 1/2005 | Mills, Jr. | 52/60 |
| 6,945,005 | B2 | 9/2005 | Nunley | |
| RE38,950 | E | 1/2006 | Maiers | |
| 7,451,572 | B1 * | 11/2008 | Inzeo et al. | 52/60 |
| 7,647,730 | B1 * | 1/2010 | Inzeo et al. | 52/60 |
| 7,748,173 | B1 * | 7/2010 | Inzeo et al. | 52/60 |
| 8,205,396 | B2 * | 6/2012 | Atiyeh et al. | 52/60 |
| 8,281,521 | B1 * | 10/2012 | Rasmussen et al. | 52/60 |
| 2003/0159379 | A1 | 8/2003 | Pickler | |
| 2003/0177727 | A1 * | 9/2003 | Gatherum | 52/302.6 |
| 2003/0177736 | A1 * | 9/2003 | Gatherum | 52/741.1 |
| 2004/0237443 | A1 * | 12/2004 | Haley et al. | 52/545 |
| 2006/0053699 | A1 * | 3/2006 | Lolley et al. | 52/58 |
| 2006/0101726 | A1 * | 5/2006 | Collins | 52/58 |
| 2007/0256371 | A1 * | 11/2007 | Gembala | 52/96 |

* cited by examiner

WATERPROOF DECK FLASHING SYSTEM AND METHOD

CROSS-REFERENCE TO RELATED APPLICATIONS

This application claims the benefit of provisional patent application Ser. No. 61/320,921 filed 2010 Apr. 5 by the present inventors.

FIELD OF INVENTION

This invention relates to an exterior waterproof deck flashing system and method for constructing a waterproof deck. The invention provides a system which alleviates installation problems and insures that water hitting and seeping through the topping surface will drain off the free edge of the deck without penetrating the underlying subfloor and support structure.

BACKGROUND

It is common practice in the construction industry to construct waterproof exterior decks. Such decks are typically constructed between vertical supports such as walls and posts. A subfloor is generally constructed on joists running between the vertical supports such that the subfloor slopes away from the building structure and toward the free edge. A waterproof deck flashing system is typically used to protect the vertical support to free edge transition as wells as define the outer edge of the topping surface. The sheet metal flashing and subfloor are protected by a waterproof sheet which allows water to drain off the deck without penetrating the subfloor. A drainage sheet otherwise called a protective sheet may be installed on top of the waterproof sheet to protect it from damage. A topping surface, typically a lightweight concrete or mortar/tile surface, is installed on top of the protective sheet. The topping surface is poured onto the protective sheet. The outside edge of the sheet metal flashing system defines the outside edge of the topping surface. These decks are designed so that water penetrating the topping surface and seeping down to the waterproof sheet will flow toward and off the free edge of the deck without penetrating and damaging the subfloor and vertical support structure. A number of sheet metal flashing designs have been used to accomplish this goal.

Typical waterproof decks utilize a sheet metal flashing system made of galvanized sheet metal (GSM). There are several components which make up the system. The flashing which protects the subfloor to vertical support transition is usually referred to as "deck-to-wall" or "wall flashing" even though it might otherwise be applied to a subfloor to post transition. It is typically "L" shaped 18 gauge GSM sheet metal which is placed such that the vertical leg extends upward along the wall (or post) and the horizontal leg extends horizontally over the top of the subfloor. Wall flashing which extends around a corner or post may also be called "saddle flashing."

The flashing which protects the free edge of the deck subfloor is typically called "edge flashing". It is typically "L" shaped 18 gauge GSM which is placed about the free edge of the subfloor such that the horizontal leg extends back several inches from the outside edge and over the top horizontal surface of the subfloor. The vertical leg of the edge flashing typically extends downward several inches from the free edge over the subfloor edge and sometimes covering the outside edge of the subfloor-to-joist transition below the subfloor. The bottom portion of the vertical leg of the edge flashing is often called the "drip edge" because it is the edge which escaping water drips off and away from the building. Typical drip edges are flanged away from the deck at an angle to prevent water from dripping onto the subfloor materials.

In a typical prior art deck construction, waterproof sheet material is placed over flashing to prevent water from penetrating the flashing system and subfloor. Once wall flashing and edge flashing components have been nailed in place, a waterproof sheet is rolled over the subfloor extending downward from the top edge of the vertical wall flashing, over the horizontal leg of the wall flashing, over the deck subfloor surface, over the horizontal leg of the edge flashing, and downwards over the vertical extending leg of the edge flashing.

Before a liquid topping surface can be installed on top of the deck, the outside edge of the deck must be established to prevent the liquid topping (usually concrete or mortar) from spilling over the free edge of the deck and to define the outside edge of the deck topping surface. Typically, this outside edge is accomplished through use of a T-bar flashing strip installed at the free edge of the deck. A T-bar flashing strip is an elongated strip of sheet metal which is T-shaped in cross section. It is installed such that the stem of the T lies horizontally on the horizontal leg of the edge flashing with the crosshead of the T extending out and beyond the free edge. The stem of the T is usually secured by nailing fasteners through the stem, through the protective and waterproof sheets, through the horizontally extending portion of the edge flashing and into the subfloor. The placement creates a gap between the vertical leg of the edge flashing and the downwardly extending portion of the T-bar crosshead. The system is designed so that water seeping between the horizontally placed T-bar stem and the waterproof sheet will escape over the free edge. If the T-bar strip was placed such that the crosshead abutted the free edge, the flow of water would be blocked at the free edge.

In typical installations using T-bar flashing strips, the outside edge of the topping surface is defined by the upwardly extending portion of the T-bar crosshead. The upwardly extending lip portion of the crosshead allows for installation of liquid topping surface directly onto the waterproof sheet and holds the topping material in place while it sets. In cases where a protective sheet is used over the waterproof sheet, the protective sheet serves to protect the waterproof sheet from damage by the topping material or from damage inflicted by installers who might walk on the deck prior to installation of the topping surface.

Numerous problems have been identified with this typical prior art deck construction. One major problem is that water will often move through the water permeable topping material, penetrate the waterproof sheet, and seep into the subfloor and structural supports creating staining and further water damage. While much or most of the water hitting the deck topping material will run along the top surface down slope and toward the free edge of the deck, some water hitting the deck topping surface will penetrate the water permeable topping material and seep down to the waterproof sheet. Water accumulating on the waterproof sheet tends to move down slope toward and over the free edge of the deck. But often times the water will also move downward through penetrations in the waterproof sheet (created by damage, wear or poor installation) and into the subfloor and vertical supports structure.

The problem of water penetrating the waterproof sheet at or near the free edge of the deck is exacerbated when it is blocked by a T-bar stem mounted directly on top of the waterproof sheet. Water accumulates at this location and either moves laterally toward a deck corner or will seep through fastener penetrations or other penetrations in the waterproof sheet.

Various prior art flashing systems have been utilized in an attempt to alleviate water seepage. For example, wall flashing has been designed to extend above and below the free edge of the deck and utilized open channels placed at the abutment of the T-bar strip to wall flashing to facilitate better drainage at the wall to free edge juncture (see U.S. Pat. No. 6,725,617). Other designs utilize weep holes punched in the upwardly extending portion of the T-bar crosshead to allow water to weep out at the crosshead. Systems which rely on channels or weep holes are often ineffective because either the holes are not large or numerous enough and/or they get blocked by topping materials. In situations relying on installation of weep holes in the field it is common for such holes to be positioned ineffectively positioned (such that, for example, the weep holes are too high above the horizontally positioned stem to allow for adequate water drainage).

Some prior art systems have utilized spacers placed between the horizontally extending T-bar stem and the waterproof sheet to provide additional drainage passage between the T-bar stem and the waterproof sheet (See U.S. Pat. No. 5,546,719). But systems relying on spacers tend to be ineffective because the spacers are either not high enough, cause excess weigh to be distributed onto portions of the waterproof sheet thus tearing or damaging it, and/or allowing the T-bar stem to bend downward between spacers and inhibit water passage.

The use of fasteners (such as nails or screws) to fasten the T-bar stem to the edge flashing is, again, a major cause of water seepage because fastener penetrations provide a direct conduit for water to seep through the waterproof sheet to the subfloor. Some prior are systems utilize special materials, such as self sealing waterproof sheeting material, to mitigate water seepage through fastener holes. Waterproof sheeting materials such as Bituthane polyurethane manufactured by R.W. Grace can, for a limited period of time, adhere to the sides of fasteners penetrating the waterproof sheet. But such self sealing products often don't seal completely and will eventually fail over time. Further failure of the seal between materials and the fasteners results from movement of the flashing system over time as a result of transfer forces on the deck surface (for example, deflection caused by persons or heavy objects on the deck) or differential movement and settling of the deck structure post construction all of which is commonly experienced by deck structures over time. Such movement is further exasperated by inadequately spaced or driven fasteners. Nailing can be inconsistently spaced, over driven or under driven. In adequate nailing is common in the construction industry where construction expertise, time and care can be limited. Movement of the flashing on top of the waterproof sheet will rip or tear the waterproof sheet particularly in those areas already experiencing degradation as a result of water seepage.

Improper nailing is not the only installation problem. The various deck flashing components need to be properly fitted to the deck edge and to the vertical supports so that they are in line with one another and so that fasteners can be properly spaced. Adjacently placed materials, such as lengths of edge flashing, must be caulked or sealed. Any gaps left between edge flashing will provide an avenue for water to penetrate into the subfloor and/or a rough surface transition which will eventually cause damage to the waterproof sheet. No amount of caulking or sealant will completely make up for installation problems which provide additional avenues for water to seep into and damage subfloor and support materials.

Further, flashing systems can be difficult to install because decks come in a variety of sizes with significant detail changes that require the installers to coordinate their efforts with other trades and to be extra careful in fitting the various components to the deck subfloor and adjacent materials. Multiple tradesmen (including framers who build the support structure, waterproofers who install the waterproof sheeting and sealants, sheet metal subcontractors who typically install the sheet metal, and pavers who typically install the topping surfaces) can be involved in the installation process. And deck systems can be susceptible to damage from worker traffic particularly prior to installation of topping materials. The waterproof sheeting can be susceptible to tears. Flashing components may expand or contract in the open elements. Installation of building components in adjacent locations to the deck can cause movement in the subfloor which can create gaps in adjacently installed materials. Also, installation of flashing components installed directly adjacent to one another (and which do not overlap) are susceptible allowing gaps that are often left unfilled. Thus, deck flashing systems that have too many components or which require too much cutting and fitting can be particularly problematic to install and maintain.

SUMMARY OF INVENTION

The problem of water seeping through flashing and waterproofing materials is alleviated by a deck flashing system which 1) does not obstruct the flow of water at the free edge, 2) does not utilize fasteners which penetrate the waterproof sheet, 3) provides for overlapping and easily sealable components, 4) provides for easy positioning of fasteners, and 5) is easy to install in the field.

The present invention is an integrated of a "two-component" deck flashing system and method for installing the same. The first component is an "L" flashing strip with attached cleats. The cleats are attached directly to edge flashing strip utilizing clinch lock joints which alleviate the need for fasteners which, in prior art systems, can easily damage waterproof sheeting materials. The second component is a cover plate which is attached to the cleats and defines the outside edge of the topping surface. All wall flashing is integrated with adjacent edge flashing components to alleviate the need for sealants at the wall to surface abutment. All adjacently installed components are overlapping and contoured to provide for a flush, easily sealed and maintained, top surface. Edge flashing components utilize pre-punched and spaced holes to guide fasteners. This two-component system can be installed more easily and effectively in the field than prior art systems and is designed for use with a variety of corner configurations.

BRIEF DESCRIPTION OF THE DRAWINGS

Other objects, features and advantages of the present invention will be apparent from the written description and the drawings in which.

DETAILED DESCRIPTION

Figure 1:
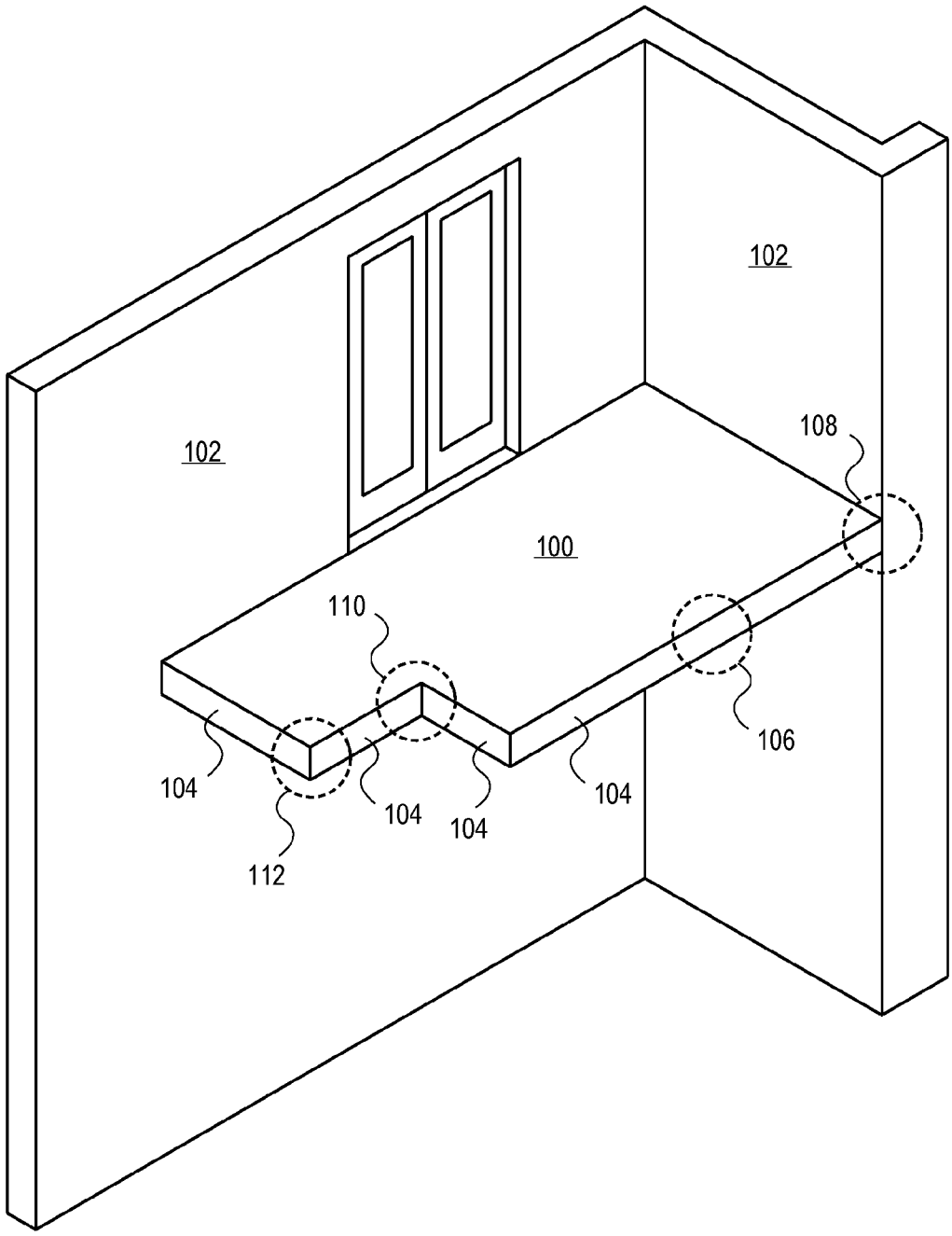
FIG. 1 is a perspective view of a general schematic deck plan showing sample locations where specific configurations of the inventive system may be installed.
Figure 3:
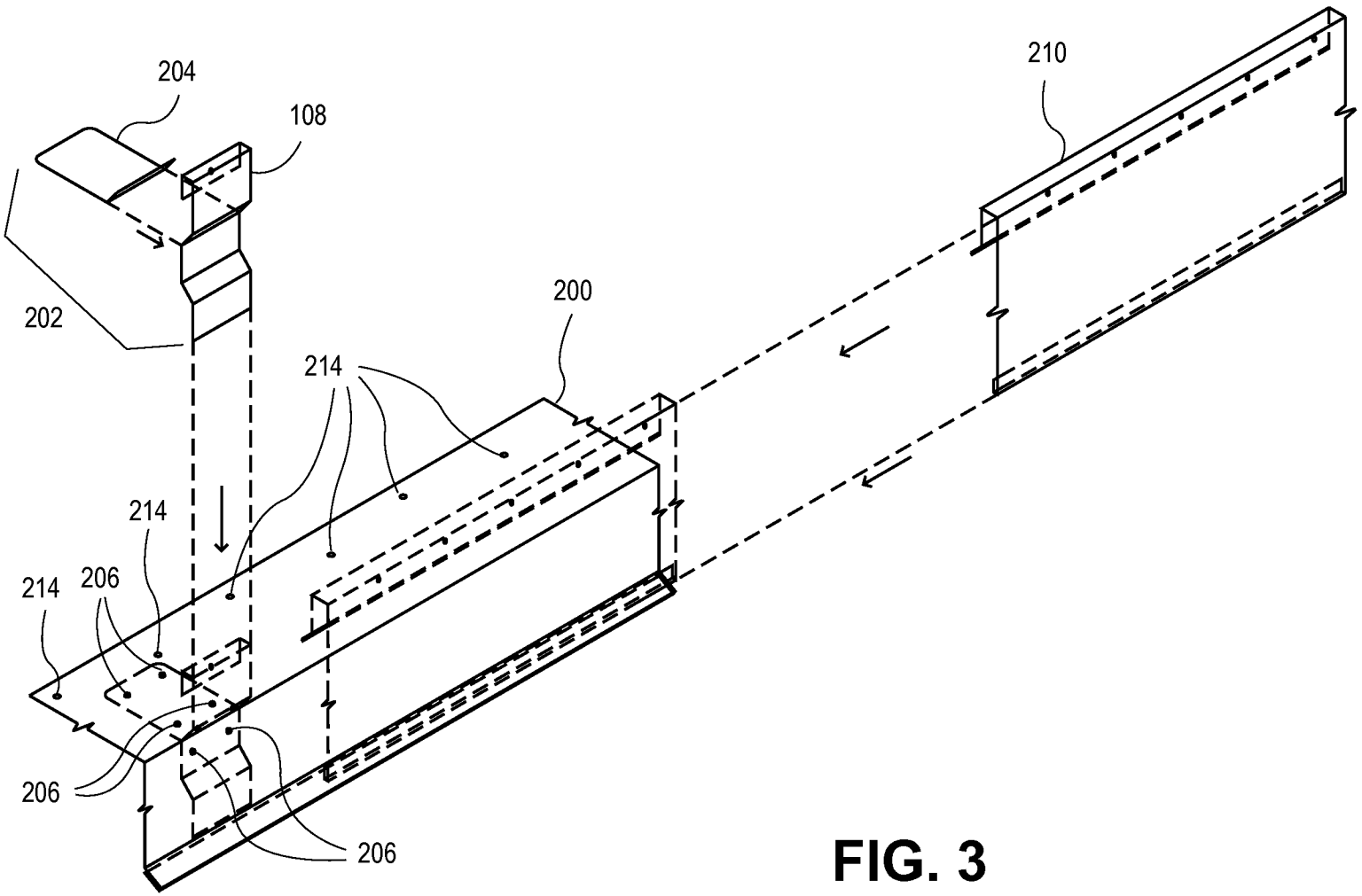
FIG. 3 is an exploded perspective view of deck edge flashing components embodying the principles of the present invention including "L" flashing strip, attached cleat, and a cover plate.
Figure 4:
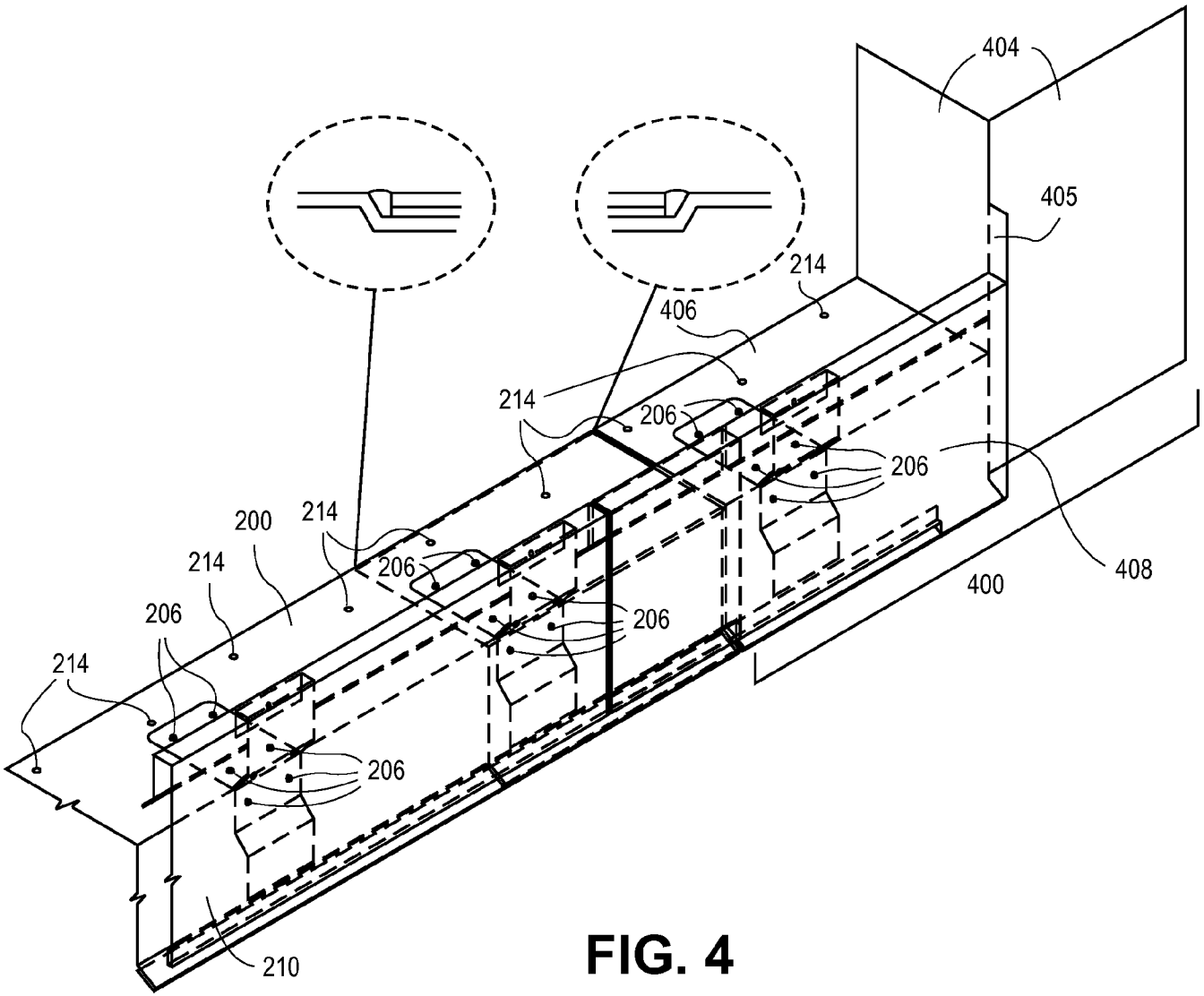
FIG. 4 is a perspective view of deck flashing components embodying the principles of the present invention including saddle flashing, saddle "L" flashing extension, overlapping "L" flashing strip, attached cleats, and cover plate.
Figure 5:
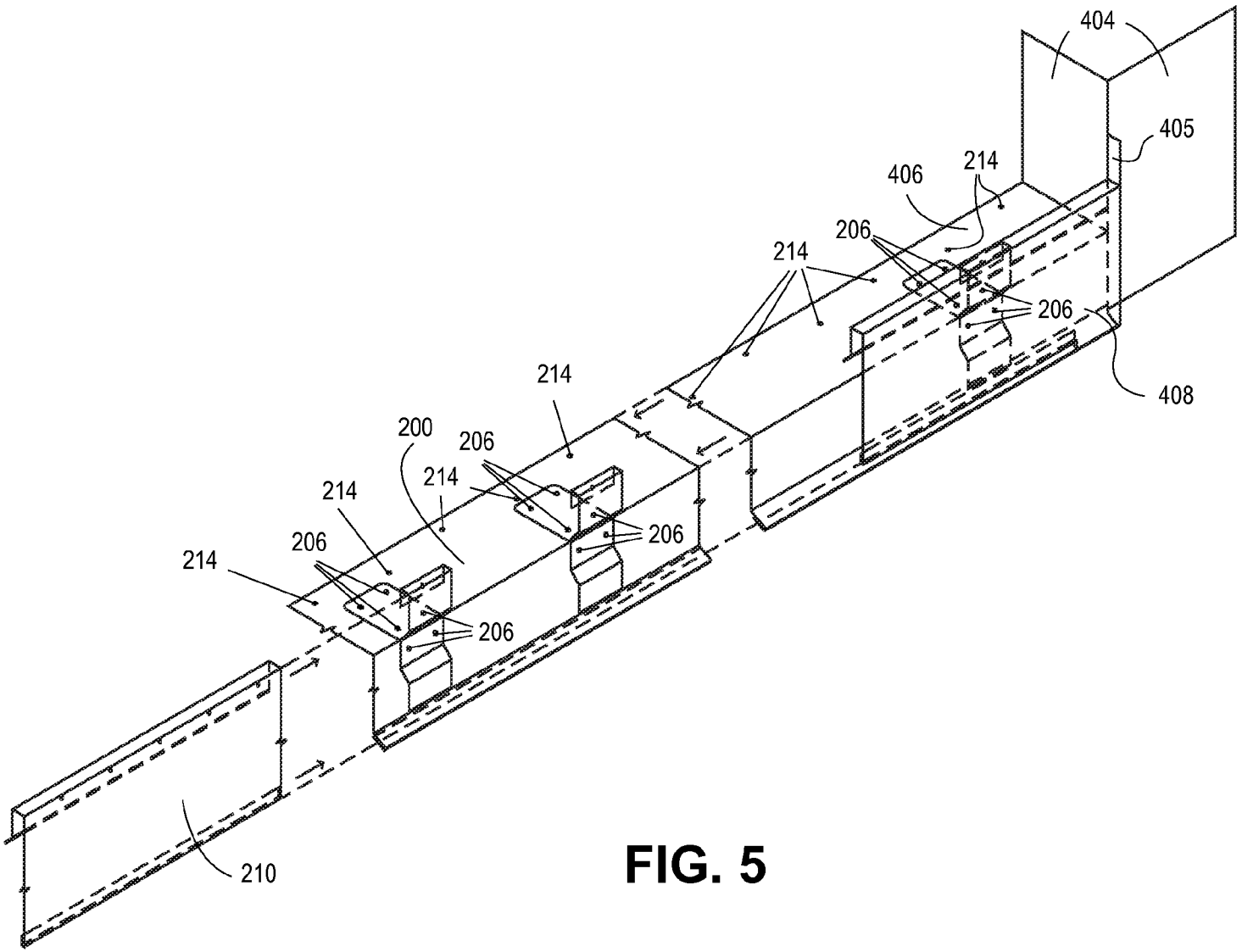
FIG. 5 is an exploded perspective view of deck flashing components embodying the principles of the present invention including saddle flashing integrated with "L" strip and attached cleats, and cover plate.
Figure 6:
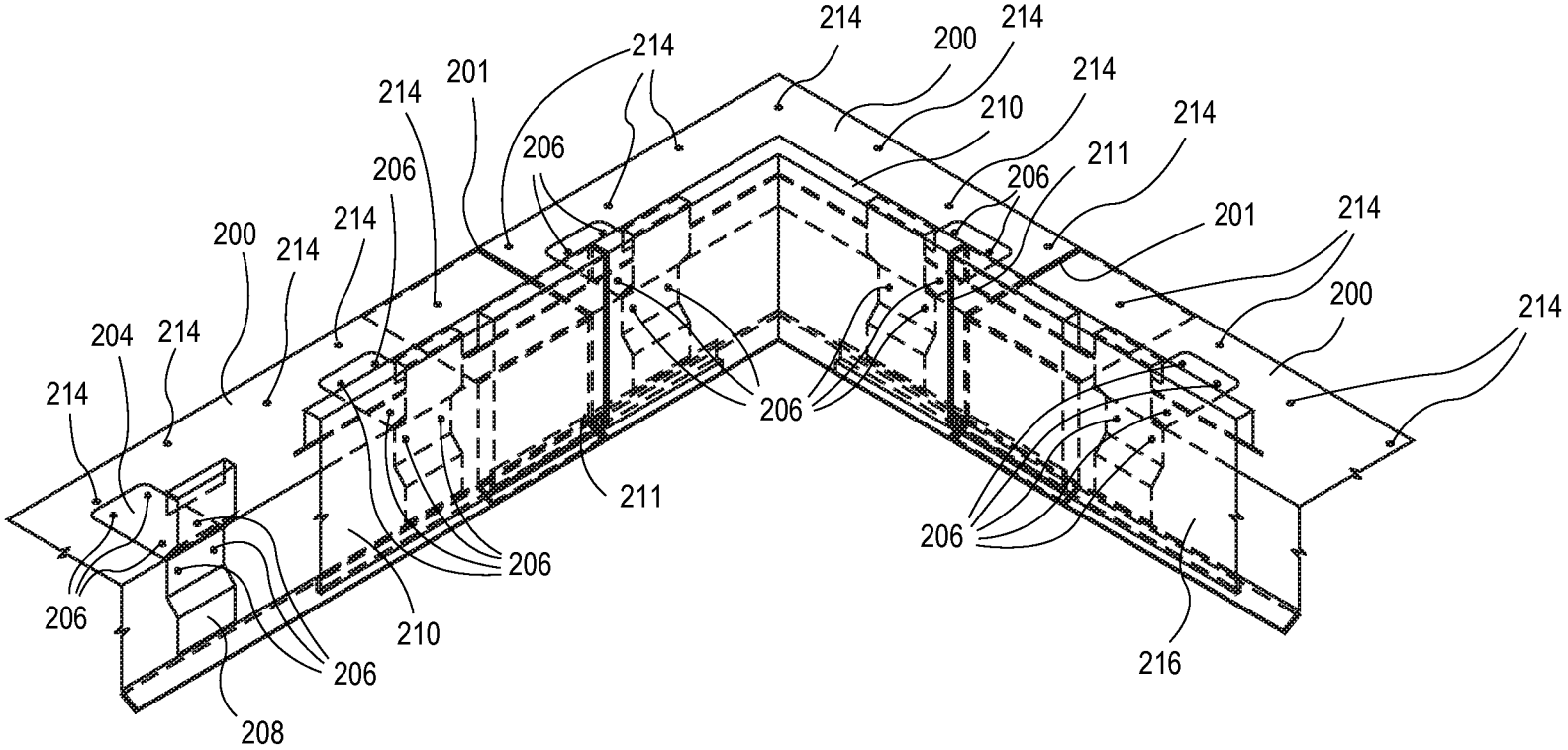
FIG. 6 is a perspective view of deck flashing components embodying the principles of the present invention configured for use on an inside corner of a deck including overlapping "L" flashing strip with attached cleats, and cover plates.
Figure 7:
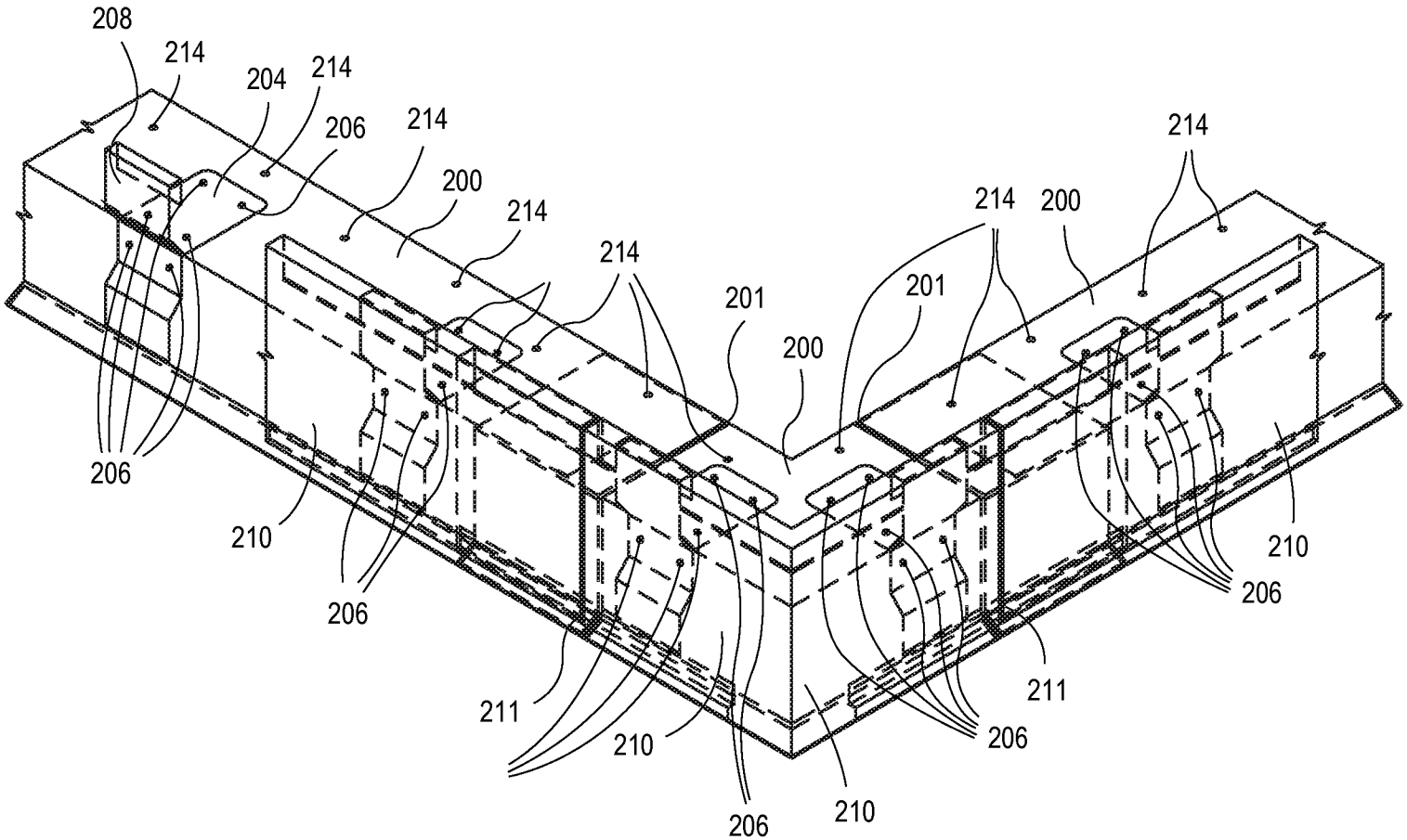
FIG. 7 is a perspective view of deck flashing components embodying the principles of the present invention configured for use on an outside corner of a deck including overlapping "L" flashing strip with attached cleats and cover plates.

Referring now in more detail to the drawings, FIG. 1 is a perspective view of a general schematic deck plan showing sample locations where specific configurations of the flashing system embodying the principles of the present invention may be installed. A deck subfloor (100) is mounted between two adjacent vertical walls (102) of a building structure. This configuration may also have an outside support or post (not shown). In an alternative configuration, the deck subfloor (100) may be mounted between three vertical walls in the form of a U-shape. In another alternative, the deck subfloor may be cantilevered away from a single vertical wall. The inventive system as installed on deck subfloor (100) mounted between two walls (102), as depicted in FIG. 1, is helpful in illustrating locations where the inventive flashing system is configured for use along all free edges (104), such as a mid-span location (106) (as depicted in FIG. 2 and FIG. 3), a free edge-to-wall location (108) (as depicted in FIG. 4 and FIG. 5), an inside corner location (110) (as depicted in FIG. 6), and an outside corner location (112) (as depicted in FIG. 7).

A waterproof deck subfloor (100) is typically supported on joists (not shown) extending between vertical walls or other conventional support structure. The deck subfloor (100) can be formed of various materials, but typically would be comprised of one inch thick plyboard on wooden or metal joists (of varying size depending on deck size and structural capacity requirements). The deck subfloor (100) spans the space formed by the walls (102) and/or posts (not shown). Typically, the joists are sloped so that the subfloor surface slopes downwardly away from the walls and toward the free edge(s) (104).

Figure 2:
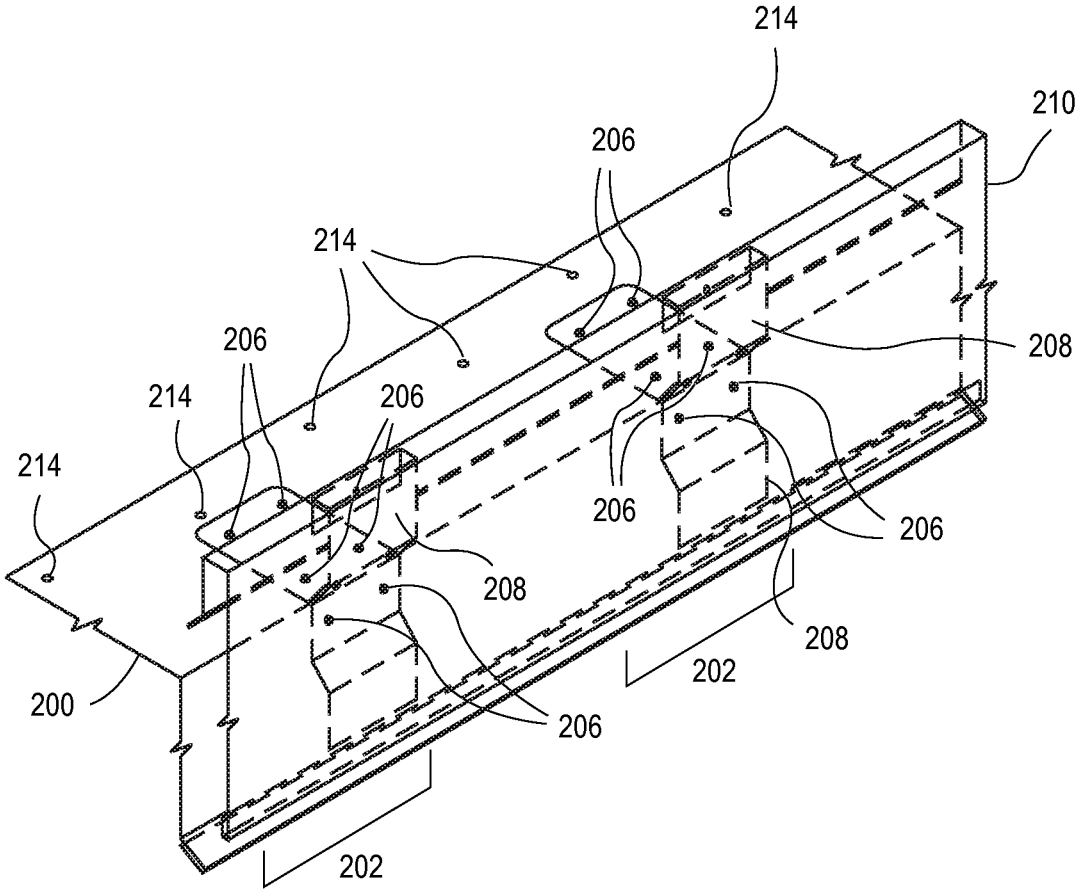
FIG. 2 is a perspective view of flashing components embodying the principles of the present invention including "L" flashing strip with cleats attached with clinch lock system and an attached cover plate.

FIG. 2 is a perspective view of flashing system components embodying the principles of the present invention configured for installation along a free edge. The integrated deck flashing components including cleats (202) having a cleat stem (204) and a cleat crosshead (208) attached to a "L" flashing strip (200) using a clinch lock joints (206). A cover plate (210) is attached to the cleat crosshead (208) using a fastener such as a tapping screw (212) (not shown in FIG. 2). The "L" flashing strip (200) is placed on the free edge of the subfloor. The "L" flashing strip (200) is L-shaped in cross section with a horizontally extending leg which is placed on the top surface of the subfloor, and a vertically extending leg which is placed so that it covers the vertical surface of the free edge.

Again, as is consistent with the inventive design, the system insures that the entire span of all free edges of the subfloor are covered by various flashing components in configurations which are designed specifically for typical locations (such as deck-to-wall locations, straight spans, inside corners, outside corners and deck-to-post locations). The specific measurements of each aspect of the flashing components described herein may be adjusted depending on the overall size of the deck subfloor, the wall/post components, structural requirements, or other typical deck components. Each component is sized so that all free edges and free edge-to-wall (or free edge-to-post locations) are protected.

The "L" flashing strip (200) as depicted in FIG. 2 can be made of any reasonably rigid and strong building material but is preferably made of 18 gauge galvanized sheet metal (GSM). The horizontal leg of the "L" flashing strip extends several inches back from the free edge. The vertical leg of the "L" flashing strip extends downward by several inches and extends outward in a hemmed flange forming a drip edge (212). The hemmed flange makes the drip edge less sharp (and therefore dangerous to install). Water running over the "L" flashing strip will flow down the vertical leg of the "L" flashing strip and drip away from the subfloor. In a preferred embodiment, the hemmed flange extends approximately ⅜" out and away from the free edge at approximately a 30 degree angle. Holes (214) are placed along the back edge of the "L" flashing strip for fasteners (not shown) used by installers to attach the "L" flashing strip to the subfloor. These holes are preferably located along the back edge of the horizontal leg of the "L" flashing strip in a staggered evenly spaced formation. The hole locations and spacing can be adjusted as long as they are spaced appropriately to secure insure a secure installation. In a preferred embodiment, the holes are approximately 5/32" in diameter and positioned approximately 3" on center. The holes are also preferably pre-punched and coated (or galvanized) to prevent degradation of the material.

The cleats (202) are attached at regular intervals at the horizontal leg of the "L" flashing strip (200). As shown in FIG. 2 and in FIG. 3 a preferred embodiment of a cleat (202) is actually two pieces—cleat stem (204) and cleat crosshead (208) which are attached together to form a single "T"-shaped piece. In such preferred embodiment, the cleat stem (204) is 2" wide and extends 2¾" to a flange extending upward ⅝" at a 45 degree angle where it terminates. The cleat stem (204) is connected to the cleat crosshead (208) at the flange using clinch lock joints (206). As shown, a preferred embodiment of the cleat crosshead (208) is 2" wide and, when attached to the cleat stem (204), extends above and below the free edge of the deck. As shown, and beginning at the bottom edge of the cleat crosshead (208), the preferred embodiment extends upward 1⅛" where it flanges inward at a 45 degree angle by 7/16" then turns upward extending 1⅛" where it preferably flanges outward at a 45 degree angle by 7/16" then turns upward again extending 2" where it turns inward 90 degrees forming a top horizontal edge and then turns downward 90 degrees creating an ⅝" tab where it terminates. In this last downwardly extending tab portion of the cleat crosshead, there is centered a 1/16" pre-punched hole used to attach the cleat crosshead (208) to the cover plate (210) using a fastener such as a taping screw (212). All parameters provided above are approximate.

Each cleat (202) is attached along the top of the horizontal leg of the "L" flashing strip (200) as shown in FIG. 3 such that the cleat stem (204) overlays the top horizontal leg of the "L" flashing strip and the 45 degree flanged portion of the cleat stem (204) extends out over the free edge (104). The cleat crosshead (208) attached to the "L" flashing strip (200) is therefore positioned to extend above and below the free edge corner (205) of the "L" flashing strip (200). The downwardly extending portion of the cleat crosshead (208) is also preferably attached to the vertically extending leg of the "L" flashing strip using clinch lock joints (206).

Each cleat (202) is attached along the horizontally extending leg of the "L" flashing strip in regular intervals. In a preferred embodiment of the flashing system, the cleats are attached approximately every 8 inches on center along the run of the "L" flashing strip (200).

As shown in the figures described above, the cleat stem (204) and cleat crosshead (208) are attached to each other and to the "L" flashing strip (200) strip using clinch lock joints (206). A cross-section view of a preferred embodiment of a clinch lock joint is depicted in FIG. 8. Each clinch lock joint (206) attaches overlapping sheet metal components together by creating a male/female locking crimp. During manufacture, force is exerted at a circularly focused area and crimped at the stem created at the opposite side to create a "ball and joint" or "male/female" bond configuration similar to an inserted snap except that the crimp at the stem does not allow the engaged materials to become easily disengaged or "unsnapped." Use of multiple clinch lock joints results in a stable connection between overlapping materials without use of fasteners which would penetrate layers of material. One advantage to using the clinch lock joints to bind overlapping materials is that penetrations are not created in the "L" flashing strip (200) which would allow water to seep below. Another advantage is that clinch lock joints do not rely on sealants or welding, which are expensive and time consuming to apply. In order to make the inventive system a "two part" system for installation purposes, the cleats (202) are attached to the "L" flashing strip during the manufacturing process (in a factory or offsite of the construction) and the "L" flashing strip (200) arrives at the site with cleats (202) already installed. Thus, the combination "L" flashing strip (200) and cleats (202) become a single flashing component for installation and can be applied easily and quickly to a deck edge using fasteners.

FIG. 3 shows an exploded view of the preferred embodiment of a cleat (202) attached to a "L" flashing strip (200) and the second component of the "two component" system, a cover plate (210). Note that FIG. 2 shows the cover plate (210) attached to one or more cleats (204). FIG. 3 merely shows how the cover plate slides over the cleat before attachment. Preferably, the cover plate (210) has a ⅜" hemmed bottom edge, a face of varying length (depending on the desired and appropriate depth of the topping surface and length of the vertical leg of the "L" flashing strip which it covers), a ⅝" top edge extending horizontally, a vertical tab portion extending downward (again, of varying length) and flanging outward toward the deck surface at a 45 degree angle ending in a hemmed edge. The hemmed edges are provided to protect against sharp edges that might injure installers during the installation process. The cover plate (210) may be made of a number of rigid and durable materials typically used in construction, but it is preferably made of 20 gauge galvanized sheet metal (GSM). The downwardly extending tab of the cover plate has evenly spaced holes, preferably every 2", which allow attachment of the cover plate to the cleat cross head using a fastener. In a preferred embodiment such as the one depicted in this figure, the fastener used to attach the cover plate (210) to the cleat crosshead (208) is a self-tapping screw (212) with neoprene washer which helps create a snug secure fit. Again, all specified limitations are approximate and depend largely on the specific requirements of each installation.

FIG. 4 is a perspective view of flashing components embodying the principles of the present invention configured for installation at a free edge-to-wall location (see 108 in FIG. 1). In this configuration, the wall saddle flashing (400) protects the vertical wall support structure where the free edge (104) meets a wall. This wall saddle flashing (402) is comprised of a flat plate (or plates) (404) which are placed in the flat abutment with the vertical wall or support post at the free edge of the deck where it meets a wall or post. These plates are preferably continuous with a section of "L" flashing strip which can be called, in this instance, an "L" flashing extension (406) for purposes of distinguishing it from an adjacently mounted piece of "L" flashing strip (200). This "L" flashing extension (406) extends from the wall plates (404) over the free edge of the deck which is immediately adjacent to the wall. Together, the plates and "L" flashing extension make up a type of "saddle flashing" as it is termed in the construction industry. The wall plates (404) of the saddle flashing extend over the outside edge of the deck in a flange that extends below the free edge (104). The preferred embodiment of these wall plates (404), for a typical deck-to-wall location shown in FIG. 1, preferably extend along the vertical surface of the wall above and below the free edge of the deck to protect that portion of the wall immediately adjacent the deck corner. As shown in FIG. 4, one or more cleats (202) are attached to the "L" flashing extension (406) as well as a cover plate extension (408) which extends from the wall plate flange at the corner of the deck edge. The end of the cover plate extension (408) abuts the flange (405) extending from the wall plate (404) and is sealed or welded thereto creating a one-piece wall corner flashing configuration which is preferably installed at the deck-to-wall location using fasteners installed through 5/32" pre-punched holes which are positioned in a staggered configuration spaced 3" on center along the back edge of the "L" flashing extension (406). The specific limitations provided above are approximate and depend on specific construction conditions.

As depicted in FIG. 4, the end of the "L" flashing extension (406) jogs to allow an adjacently placed piece of "L" flashing strip (200) to be installed on top of a portion of the extension with sufficient overlap to prevent seepage of water between the two components. Preferably, the overlap will be at least 4". This jog in the "L" flashing extension (406) allows for an overlap with easy installation of a continuous soldier joint to bind it and the adjacently installed "L" flashing strip (200) together to create a relatively smooth, solid and continuous junction between these adjacently installed components. Preferably, the vertical leg of the "L" flashing extension (406) ends in a flanged hemmed drip edge similar to the drip edges described for the "L" flashing strip (200) more particularly described with respect to FIG. 2 and FIG. 3. Also as depicted in FIG. 4, a cover plate (210) is preferably installed in overlapping fashion over the end portion of the cover plate extension (408). A jog in the end of the cover plate extension approximately 4" from the end allows for easy overlap by the cover plat (210). All limitations provided above are approximate.

FIG. 5 is an exploded view of flashing components embodying the principles of the present invention also depicted in FIG. 4. The size of the wall plate(s) (404) and flange (405) will vary in size depending of the dimensions of the free edge-to-wall juncture. The cover plate-to-flange junction is sealed either by weld or made as a single piece. The cover plate (210) is attached to the "L" flashing extension (406) using a cleat (202) which is mounted thereon as it would on a "L" flashing strip (200) as previously described. At the cover plate-to-wall plate juncture, the bottom edge of the cover plate extension (408) comes in contact with the flange (405) and extends laterally for approximately 2 inches to form a channel or opening (410), as shown. This allows water to exit more freely at this juncture. Again, all specific limitations described above are approximate.

In a preferred embodiment of the configuration described above, the wall plate(s) (404) and flange (405) are made of 20 gauge galvanized sheet metal (GSM). The flange (405) may be soldiered or welded to the cover plate extension (408) to create a closed end. Also in a preferred embodiment, the "L" flashing extension (406) and cover plate extension (408) are made of 18 gauge galvanized sheet metal (GSM). The cleat(s) (202) attached to the "L" flashing extension is/are also made of 18 gauge galvanized sheet metal and is attached to the "L" flashing extension (406) preferably using clinch lock joints as previously shown and described in conjunction with FIGS. 2, 3 and 8.

FIG. 5 also depicts a section of an "L" flashing strip (200) with cleats (202) designed to be installed immediately adjacent to the "L" flashing and cover plate extensions. The cover plate (210) is designed to be installed on the cleats (202) of the "L" flashing strip (200) as shown in FIG. 4. The specifications of the "L" flashing strip (200) and cover plate (210) depicted in FIGS. 4 and 5 are similar in design to those installed along a free edge span of the deck as shown in FIGS. 2 and 3. FIGS. 4 and 5 show how the wall flashing components integrate with adjacently installed "L" flashing strip (200) and cover plate (210) components.

FIG. 6 is a perspective view of a flashing system embodying the principles of the invention which is configured for installation at an inside corner of a deck edge (see location 110 on FIG. 1). An inside corner at the deck edge requires the "L" flashing strip (200) be designed to fit the corner without allowing any open beveled edges. Similarly, the cover plate (210) attached to cleats (202) installed on the "L" flashing strip (200) as shown is also continuous and has no open seams or bevels at the inside deck corner. The "L" flashing strip (200) component and cover plate (210) component also have a jog at their outside ends (201 and 211 respectively) to allow adjacently installed "L" flashing strip materials and cover plates to over lap and be sealed continuously thereto using soldier or sealant providing a solid, smooth and continuous juncture. The inside edge "L" flashing strip (200) is installed onto the subfloor with fasteners through pre-punched staggered holes consistent with those as described above relative to FIGS. 2-5.

FIG. 7 is a perspective view of a deck flashing system embodying the principles of the present invention what are configured for installation at an outside corner edge of a deck (See location 112 depicted in FIG. 1). Here, the "L" flashing strip (200) and attached cover plate (210) are configured to be continuous and fit the outside corner without allowing any open or beveled edge at the corner as would be apparent for separate adjacently installed pieces jointed at the corner. Similar to the inside corner configuration described in FIG. 6, the "L" flashing strip (200) and attached cover plate (210) are designed with a jog at the ends (201 and 211 respectively) preferably to allow a minimum approximately 4" overlap of adjacently installed "L" flashing strip (200) and cover plate (210) components. The "L" flashing strip is installed onto the deck subfloor using fasteners through pre-punched staggered holes consistent with the "L" flashing components previously described.

Figure 8A:
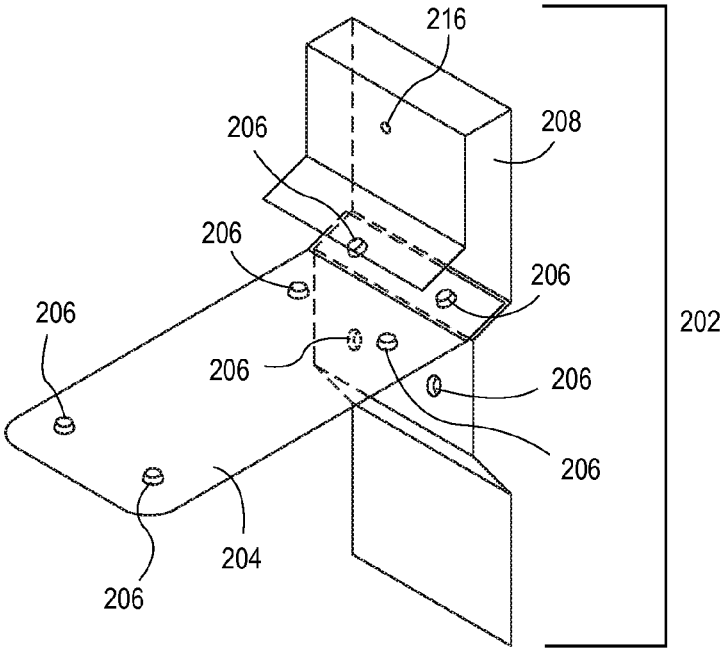
FIG. 8A and FIG. 8B are cross sectional views of deck flashing components embodying the principles of the present invention including a cleat mounted to an "L" flashing strip using the clinch lock system and a cover plate attached to a cleat.
Figure 8B:
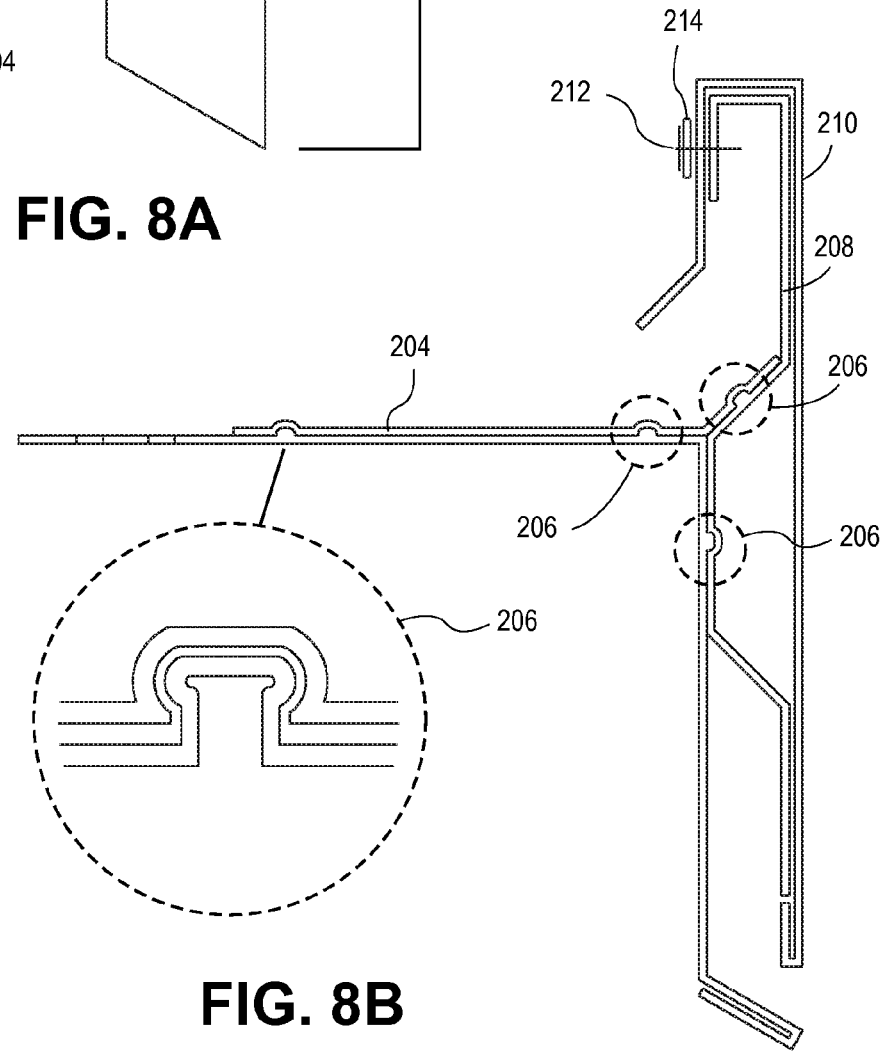

FIG. 8A shows a perspective view of a cleat (202) with cleat stem and FIG. 8 B show a cross sectional view of flashing components embodying the principles of the present invention as mounted together as a two component system as well as a perspective view of a cleat (202) including cleat stem (204) attached to a cleat crosshead (208) using clinch lock joints (206). FIG. 8 B shows a cross sectional view of a preferred embodiment of a cleat (202) mounted to a "L" flashing strip (200) using clinch lock joints (206). Note that clinch lock joints are used to attach the cleat stem (204) to the cleat crosshead (208), the cleat stem (204) to horizontal leg of the "L" flashing strip (200), and the cleat crosshead (208) to the vertical leg of the "L" flashing strip (200). The cover plate (210) is mounted to the upper portion of the cleat crosshead (208) using a fastener such as a tapping screw (212) with neoprene washer (214). Note that FIG. 8A, showing a perspective view of the cleat (202), shows a predrilled hole (216) for mounting the cover plate (210) as well preferred locations for clinch lock joints (206) used to mount the cleat stem (204) to the cleat crosshead (208), the cleat stem (204) to the horizontal leg of the "L" flashing strip (200), and the cleat crosshead (208) to the vertical leg of the "L" flashing strip (200).

Figure 9:
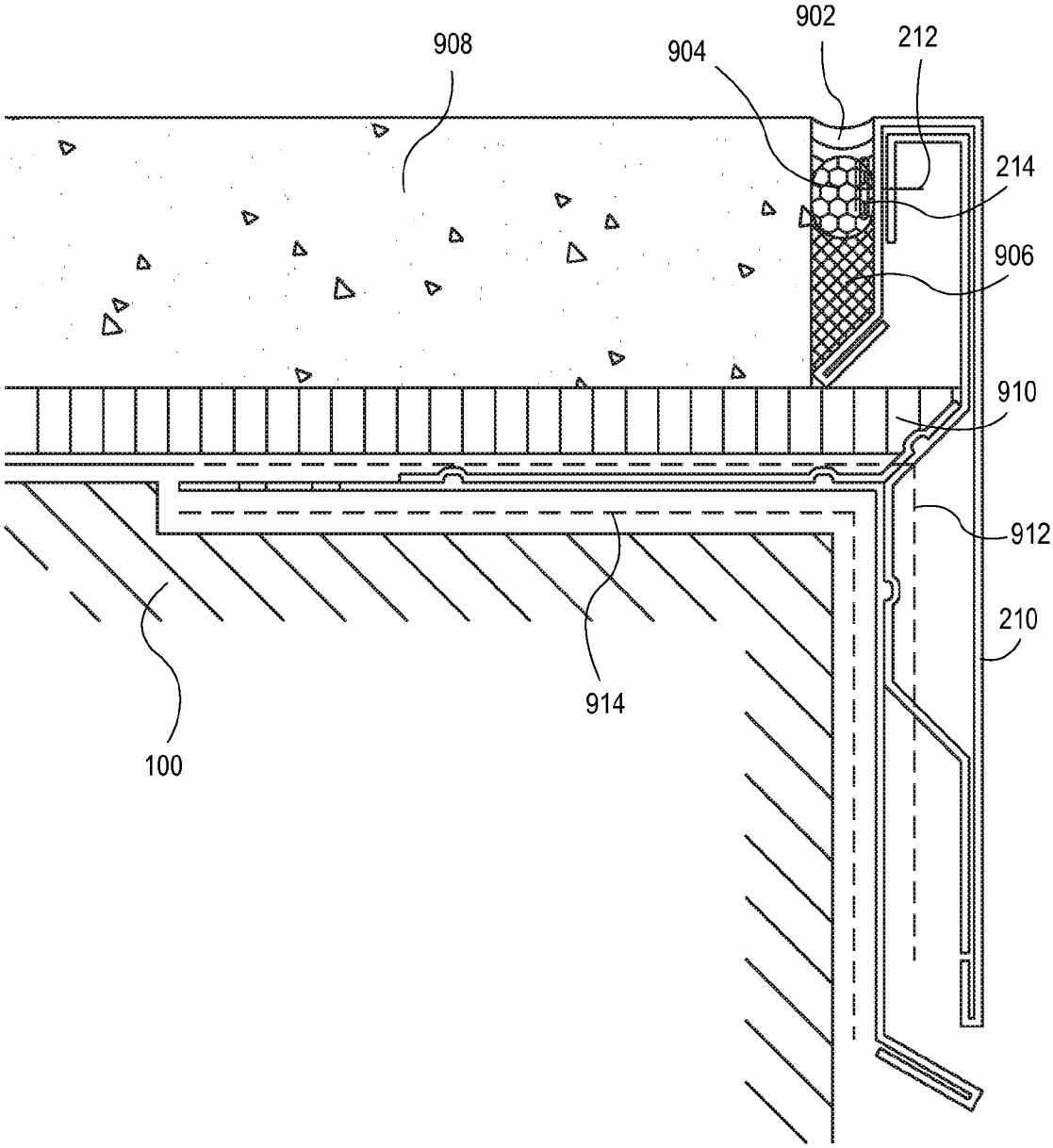
FIG. 9 is a cross sectional view of deck flashing components embodying the principles of the present invention including "L" flashing strip mounted on a subfloor with cleat, cover plate, waterproof sheet, drainage sheet, concrete topping material, sealant, backer rod and joint isolation filler.

FIG. 9 shows a cross sectional view of a flashing components embodying the principles of the present invention as mounted to a free edge (104) of a deck. As depicted, additional components in the final installation will preferably include sealant (902), backer rod (904) and joint isolation filler (906) mounted between the surface topping material (908) and the top inside vertical flange of a cleat crosshead (208) as well as drainage sheet (910) (otherwise called a protective sheet) installed over the waterproof sheet (912), over the horizontal leg of the "L" flashing strip (200) and up the flanged portion cleat crosshead. The waterproof sheet (912), by contrast is installed over the subfloor and extends over the horizontal leg of the "L" flashing strip, over the corner edge of the "L" flashing strip and down the vertical leg of the "L" flashing strip and terminates at the flanged hemmed drip edge. The "L" flashing strip (200) is installed onto the free edge (104) of the deck with, preferably, some deck substrate (914) installed between the top surface of the subfloor and the bottom surface of the horizontal leg of the "L" flashing strip to help align the strip flush with the free edge. A cover plate (210) is mounted on the cleat (202) by fitting the cover plate over the cleat crosshead (208) as shown and fastening the cover plate (210) to the crosshead (208) using a fastener, such as a tapping screw (212) with neoprene washer (214) as shown.

A preferred method for installing the preferred embodiments of the inventive design as depicted in FIGS. 2 through 9 includes the following steps:

attaching a deck subfloor to a building;

applying DAP deck substrate as required at all free edges of the subfloor;

attaching deck-to-wall saddle flashing with "L" flashing extensions and cover plate extensions at all deck-to-wall junctures;

attaching "L" flashing strips with pre-attached cleats along all free edges of the subfloor such that the ends of said "L" flashing strips overlap adjacent "L" flashing strips and "L" flashing extensions;

applying waterproof sheeting material over said subfloor such the material extends over all horizontal legs and down all vertical legs of the "L" flashing strips and "L" flashing extensions terminating at all drip edges;

applying drainage sheeting material over waterproof sheeting material such that said drainage sheeting material terminates at all cleat crossheads;

attaching a cover plates such that the ends of said cover plates overlap adjacent cover plates and cover plate extensions;

pouring a liquid topping material over said drainage sheeting material covering subfloor to a level approximately with the top vertical edge of all cleat crossheads;

allowing liquid topping material to harden and contract thus allowing gaps to form between cover plates and topping material as well as between cover plate extensions and topping material;

applying sealant, backer rod and joint isolation filler to gaps formed between cover plates and hardened topping material as well as between cover plate extensions and hardened topping material.

Consistent with the principles of the present invention and otherwise described depicted in FIG. 9, protective drainage sheeting material (904) may be spread over and cover the upper surface of the waterproof sheeting material (902). The purpose of the protective or drainage sheeting material (904) is to protect the waterproof sheeting material (902) from damage caused by or prior to the installation of the topping material when the waterproof sheeting material is vulnerable to rips and tears caused by workers walking on the waterproof sheeting material (902) and/or the waterproof sheeting material is exposed to environmental elements during construction process. Further, the protective sheeting (904) material protects the waterproof sheeting material from wear caused by the expansion and/or contraction of the topping material during and after application of the same.

Also consistent with the principles of the present invention and otherwise depicted in FIG. 9, liquid topping materials have a tendency to contract during the hardening process. This contraction during the hardening process can, in many instances, cause gaps to form between the hardened topping material and the cover plate. To fill these gaps and maintain both the waterproof integrity of the deck as well as the aesthetic integrity of the deck, it may be necessary to fill the gaps with sealants, backer rod, and joint isolation filler. In some instances, no gaps will form and/or small gaps will form requiring only the installation of sealant where the topping material abuts the cover plate. But, where larger gaps are formed in this location, joint isolation filler is first applied in the gap, followed by installation of backer rod and application of sealant.

Liquid waterproofing products may be applied to the top surface (i.e. walking surface) of the hardened topping material to assist the majority of water falling on the top surface to move toward and off the free edge of the deck. But topping materials such as concrete are generally permeable to water and, therefore, it is difficult if not practically impossible to prevent some water from seeping through the topping material and down to the waterproof sheet. When such seepage occurs, water will accumulate on top of the waterproof sheet and move toward the free edge of the deck. When the water reaches the free edge, it will run over the horizontal leg and down the vertical leg of the "L" flashing strip and outward to the hemmed drip edge. Importantly, the water is not trapped at the "L" flashing strip by the cleats because there are gaps between adjacent cleats to allow water to move around and over the free edge. Clinch lock joints are used to attach the cleats to the "L" flashing strip without use of traditional fasteners which would penetrate the waterproof sheet and allow the accumulated water down to seep through penetrations and into the subfloor. In the present inventive system, water moves easily around the cleats, over the free edge and down the vertical leg of the "L" flashing strip to the drip edge. It then drips away from the building without contacting the wood subfloor.

Consistent with the principles of the present invention and as otherwise described above, the inventive flashing system more easily applied by installers than prior art systems because it is generally a "two component" system with the first component being the "L" flashing strip (and/or the wall flashing with "L" flashing extension) with mounted cleats and the second component being the cover plate. The preferred embodiments described above specifically designed for inside and outside corners are simply modifications of the this two component system. The first component is installed at the free edges and at locations where free edges abut walls and posts. Installations of the wall saddle flashing with attached "L" flashing extensions are usually performed first so that adjacent "L" flashing strips made by properly installed to overlap the end portions of the "L" flashing extensions. Overlapping portions are sealed and/or soldiered. Some DAP or other type of leveling substrate may be reasonably applied at the free edge of the subfloor prior to positioning of the first component to allow for proper alignment of the first component with the free edge. Installation of these first components is easily achieved by use of fasteners installed through the pre punched holes located along the horizontal legs of the "L" flashing strips and "L" flashing extensions. Once all first component materials are properly installed, the waterproof sheeting materials and drainage materials can be installed. The cover plates are then installed over the cleats. The cover plates are secured by a fastener (such as a tapping screw) at the upper vertically extending portion of the cleat crosshead. Once the two component flashing system is secured in place the topping surface material is applied (usually in liquid form). The cover plates serve to prevent the topping surface from running over the free edge and to create a termination at the free edge. The cover plates and cover plate extensions also serve to protect topping material at the free edges. Gaps which may form between cover plates or cover plate extensions and the topping surface may be filled with sealant, back rod and joint isolation filler as needed. Liquid waterproofing may be applied to the top surface of the topping material.

The two component system is easily to apply and, importantly, provides for a water seeping through the permeable topping material to the waterproof sheet to move over the free edge and serves to prevent perforations and penetrations in the waterproof sheet which might allow water to seep into and damage the subfloor.

We claim:

1. A waterproof deck flashing system for mounting on a free edge of a deck allowing water collecting on the deck to run off the free edge without seeping into materials upon which the system is mounted comprising:

one or more "L" flashing strips extending longitudinally along the free edge of the deck and having a horizontal leg extending horizontally over a horizontal surface of the deck at the free edge and a vertical leg extending downward from the free edge of the deck;

one or more cleats attached with the one or more "L" flashing strips, said one or more cleats having a width less than the longitudinal length of the one or more "L" flashing strips such that a plurality of the cleats may be attached along the longitudinal length of the one or more "L" flashing strips and allow water to flow between the cleats and over the free edge, and having a horizontal leg for attachment with the horizontal leg of the one or more "L" flashing strips and a vertical leg extending above and away from the free edge of the deck, wherein the horizontal leg of the one or more cleats is attachable to the horizontal leg of the one or more "L" flashing strips without penetrating the horizontal leg of the one or more "L" flashing strips or any waterproof sheet or other waterproofing materials that might otherwise be mounted on top of the horizontal leg of the one or more "L" flashing strips;

a waterproof sheet for mounting on the horizontal surface of the deck and extending over the horizontal leg of the one or more "L" flashing strips;

a drainage sheet for mounting over the waterproof sheet; and one or more cover plates which, when attached with the one or more cleats, extend vertically above the free edge of the deck to form the outside edge of any topping material that may be applied over the drainage sheet.

2. A waterproof deck flashing system in accordance with claim 1 in which the one or more "L" flashing strips for installation at free edge-to-wall locations comprises one or more wall plates and an "L" flashing extension with one or more attached cleats.

3. A waterproof deck flashing system in accordance with claim 2 having an attached cover plate extension.

4. A waterproof deck flashing system in accordance with claim 1 in which said one or more cleats are attached to said "L" flashing strip by clinch lock joints.

5. A waterproof deck flashing system in accordance with claim 1 in which the one or more cover plates are attached to the one or more cleats using one or more fasteners mounted through holes in the vertical leg of the cleats.

6. A waterproof deck flashing system in accordance with claim 1 in which the one or more "L" flashing strips are adjacently installed to one another, partially overlapping one another, and sealed to one another.

7. A waterproof deck flashing system in accordance with claim 1 in which a wall saddle flashing with "L" flashing extension and cover plate extension is attached at all wall-to-wall deck locations.

8. A waterproof deck flashing system in accordance with claim 7 in which the "L" flashing strip is attached adjacent to and over lapping with the end of the "L" flashing extension.

9. A method of flashing a waterproof deck such that water collecting on a horizontal surface of the deck may flow over a free edge of the deck without seeping into materials upon which the flashing materials are mounted comprising the steps of:

attaching one or more "L" flashing strips extending longitudinally along the free edge of the deck and having a horizontal leg extending horizontally over a horizontal surface at the free edge and a vertical leg extending downward from the free edge;

attaching one or more cleats with the one or more "L" flashing strips, said one or more cleats having a width less than the longitudinal length of the one or more "L" flashing strips such that a plurality of the cleats may be attached along the longitudinal length of the one or more "L" flashing strips and allow water to flow between the cleats and over the free edge; and having a horizontal leg for attachment with the horizontal leg of the one or more "L" flashing strips and a vertical leg extending above and away from the free edge of the deck, wherein said horizontal leg of the one or more cleats is attachable to the horizontal leg of the one or more "L" flashing strips without penetrating the horizontal leg of the one or more "L" flashing strips or any waterproof sheet or other waterproofing materials that might otherwise be mounted on top of the horizontal leg of the one or more "L" flashing strips;

applying a waterproof sheet over the horizontal surface of the deck and extending over the horizontal leg of the one or more "L" flashing strips;

applying a drainage sheet over the waterproof sheet; and attaching one or more cover plates with the one or more cleats to extend vertically above the free edge of the deck to form the outside edge of any topping material that may be applied over the drainage sheet.

10. The method of claim 9 wherein the step of installing the one or more "L" flashing strips further comprises installing "L" flashing strips having one or more wall plates at free edge-to-wall locations.

11. The method of claim 10 wherein the step of installing one or more "L" flashing strips further comprises installing "L" flashing strips having an attached cover plate extension.

12. The method of claim 9 wherein the step of attaching the one or more cleats to the one or more "L" flashing strips further comprises using clinch lock joints.

13. The method of claim 9 wherein the step of attaching the one or more cover plates to the one or more cleats further comprises using one or more fasteners mounted through holes in the vertical leg of the one or more cleats.

14. The method of claim 9 wherein the step of attaching the one or more "L" flashing strips further comprises overlapping and sealing adjacently attached "L" flashing strips.

15. The method of claim 9 further comprising the step of attaching wall saddle flashing having an "L" flashing extension and a cover plate extension to one or more wall-to-wall deck locations.

16. The method of claim 15 wherein the step of attaching wall saddle flashing having an "L" flashing extension and a cover plate extension further comprises attaching the adjacent "L" flashing strip overlapping with the end of the "L" flashing extension.

* * * * *